US005351700A

United States Patent [19]

Jones, III et al.

[11] Patent Number: 5,351,700

[45] Date of Patent: Oct. 4, 1994

[54] WALKABOUT WITH SEAT AND FALL CONTROL

[76] Inventors: Clayton H. Jones, III; Rosalie V. Jones, both of 409 Granada Ave., Isle of Capri, Naples, Fla. 33962

[21] Appl. No.: 505

[22] Filed: Jan. 5, 1993

[51] Int. Cl.[5] ..... A61H 3/00

[52] U.S. Cl. ..... 135/67; 482/66; 297/5; 280/87.021

[58] Field of Search ..... 135/66, 67; 280/304.1, 280/87.021, 87.051; 482/66, 68, 69; 297/5-7

[56] References Cited

U.S. PATENT DOCUMENTS

| | | | |
|---|---|---|---|
| 2,609,030 | 9/1952 | Stack | 280/87.051 X |
| 2,657,735 | 11/1953 | Hughes | 297/5 |
| 4,272,071 | 6/1981 | Bolton | 135/67 X |
| 4,342,465 | 8/1982 | Stillings | 297/5 X |
| 4,621,804 | 11/1986 | Mueller | 272/70.3 |
| 4,759,562 | 7/1988 | Viayard | 280/87.02 |
| 4,770,410 | 9/1988 | Brown | 297/5 X |
| 4,773,639 | 9/1988 | Graves | 482/66 |
| 4,861,051 | 8/1989 | Napper | 280/87.021 |
| 4,953,851 | 9/1990 | Sherlock | 272/70.3 |
| 5,040,556 | 8/1991 | Raines | 297/6 X |
| 5,058,912 | 10/1991 | Harroun | 297/5 X |

*Primary Examiner*—Carl D. Friedman
*Assistant Examiner*—Lan C. Mai

[57] ABSTRACT

A walkabout with fall control for assisting people with varying degrees of difficulty walking includes a base frame attached to a adjustable height top frame with a adjustable height seat and a fall control assembly which directs a person toward the seat in the event of a fall. The base and top completely encircle the person. A portion of the top pivots outward to open and allow ingress and egress of the walkabout. The seat is positioned below and at the rear of the top. An open space is provided in front of the seat for a occupant to stand and walk. Multiple upright supports taper in from the larger base to the smaller top joining the two pieces. A number of rolling devices attached to the base allow the walkabout to be moved along a walking surface. The rolling devices includes units suitable for outdoor use of the walkabout. The fall control assembly includes a strap to secure about the occupant and multiple cords fastened to the strap and the top rearward of the front of the seat. Should a fall occur the fall control assembly guides and pivots the person toward the seat, preventing him or her from hitting the floor.

18 Claims, 4 Drawing Sheets

WALKABOUT WITH SEAT AND FALL CONTROL

BACKGROUND

1. Field of Invention

The walkabout relates to walkers that assist both the disabled and rehabilitating person with the act of walking.

2. Description of Prior Art

Various types of walkers have been provided in prior art in an attempt to provide an acceptable solution. Stillings, U.S. Pat. No. 4,342,465 issued Aug. 3, 1982 resembles a walker used by toddlers learning to walk. Its low height, crotch cord and unwieldy design make it unstable and unsuitable for anyone attempting to walk in a normal manner. There is nothing to prevent or control a person falling to the rear. The hard seat and support bars present dangerous objects in the event of a fall backward. Mueller, U.S. Pat. No. 4,621,804 issued Nov. 11, 1986 is a traditional four-legged walker with castors and a crotch strap/seat added. This provides greater mobility over the prior art at the expense of stability, comfort and convenience. The four-legged frame could only be used by a person able to walk but requiring something to periodically lean on. This device would not support anyone who stumbles and falls while using the walker. The wide crotch strap is at best an inconvenience while walking and unsuitable for use as a seat. Vinyard, U.S. Pat. No. 4,759,562 issued Jul. 26, 1988 is a walker conversion for wheel chairs. It is not relative to this invention other than it is classified as a walker. Brown, U.S. Pat. No. 4,770,410 issued Sep. 13, 1988 is a walker with height adjustment provided via compressed air. This device has a seat with a strap to hold a person in the seat. It's design would not provide any stability should a person stumble while trying to walk standing up. The rigid seat extends forward, between the legs and would severely hamper any attempt to walk in a normal manner. Napper, U.S. Pat. No. 4,861,051 issued Aug. 29, 1989 is a rehabilitation walker device. It consist of a chair with two wheels and a frame extending forward and out to the sides. The frame provides two hand-grips and two wheels. The entire structure provides a three-point base. There is no support to either side, no stability in the event a person stumbles and nothing to guide them to the seat in the event they fall to the rear or side. It is unsuitable for anyone with a problem walking. Sherlock, U.S. Pat. No. 4,953,851 issued Sep. 4, 1990 is a safety mobilizer walker. The device consist of four vertical legs with a wheel on the bottom of each leg and a circular frame on the top, to which the four legs are attached. There is a sling seat. The design provides vertical support for a person needing to lean on something. It provides no support in the event a person stumbles while using it. The sling seat would be an inconvenience while walking and uncomfortable to sit in. Harroun, U.S. Pat. No. 5,058,912 issued Oct. 22, 1991 is a combination chair/walker. It consist of a chair with wheels on it's four legs and a raised bar across the front to contain the person and provide an attachment point for a sling. The sling is used to restrain a person in the event of a fall. The chair has a conventional seat and back consisting of plastic webbing or sheet material. The low sides and narrow width of the chair do not provide sufficient lateral support in the event of a fall while standing. Walking would be difficult with the sling between the person's legs and the limited room provided to step forward.

The design is unwieldy in that it forces the person to try to walk while dragging a chair behind them.

OBJECTS AND ADVANTAGES

Accordingly, several objects and advantages of our walkabout are:

(a) to provide a walker that will overcome the shortcomings of the prior art;

(b) to provide a highly stable walker capable of supporting the weight of a user who begins to fall in any direction while using the walker;

(c) to provide a walker capable of controlling and directing a falling user to prevent their hitting the floor;

(d) to provide a walker that allows the user a high degree of mobility;

(e) to provide a walker that is height adjustable for various sized people;

(f) to provide a walker with a height adjustable seat to allow both walking and sitting;

(g) to provide a walker that does not require the use of a strap or other device between the users legs;

(h) to provide a walker that is simple and easy to use;

(i) to provide a walker that is usable by persons spanning a wide range of difficulty in walking;

(j) to provide a walker that is economical in cost to manufacture;

(k) to provide a walker that is easy to maintain and service;

(l) to provide a walker that can easily accept accessories such as trays, pockets, etc.;

(m) to provide a walker that can accept other wheels for use outdoors.

(n) to provide a walker that fulfills the above without being heavy or cumbersome.

Further objects of the walker will appear as the description proceeds.

To the accomplishment of the above and related objects, this walkabout may be embodied in the form illustrated in the accompanying drawings, attention being called to the fact, however, that the drawings are illustrative only, and that changes may be made in the specific construction illustrated and described within the scope of the appended claims.

DRAWING FIGURES

DESCRIPTION—FIGS. 1 TO 5

Figure 1:
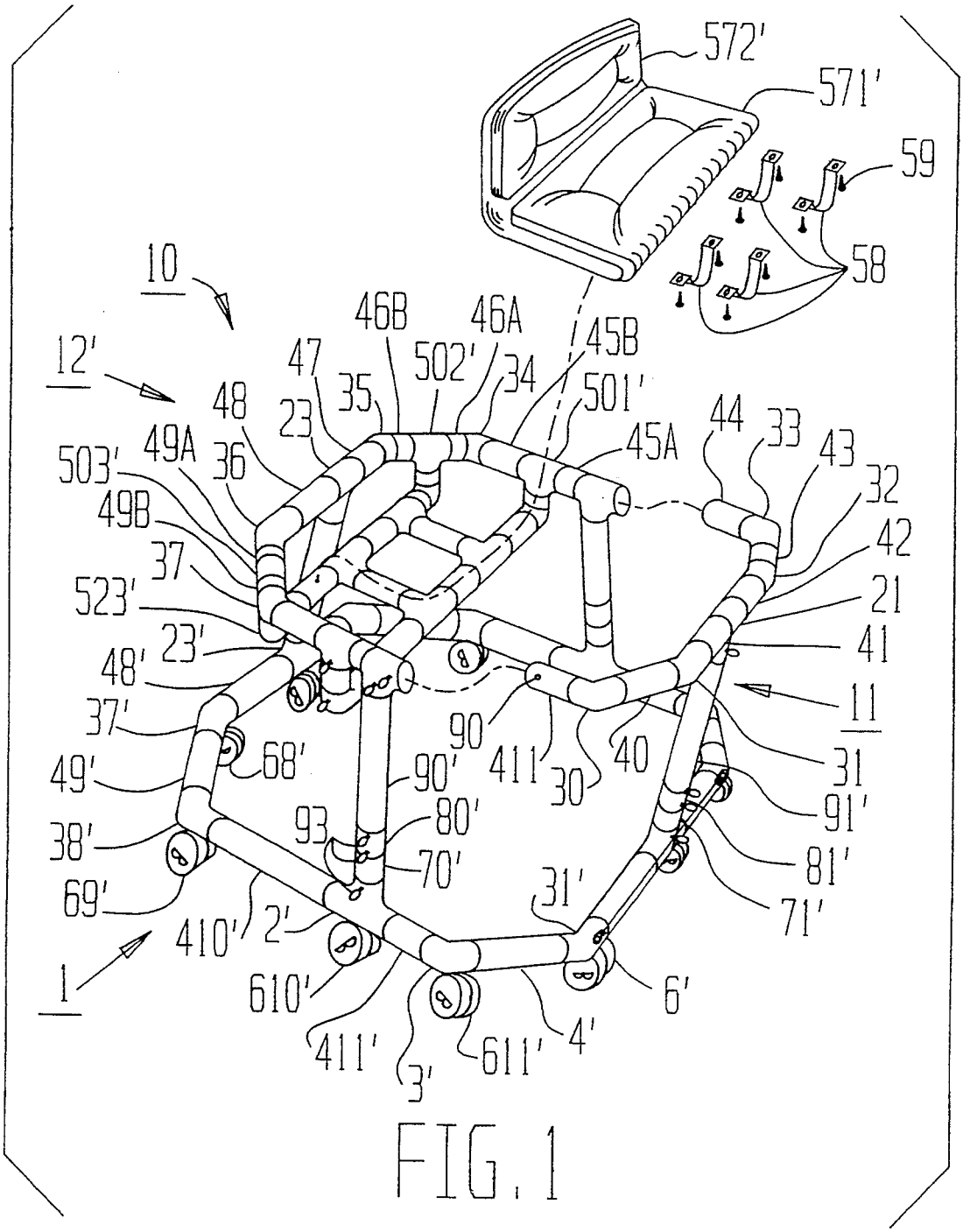
FIG. 1 is a perspective view of a preferred embodiment of the invention.

Reference should now be made to the drawings in which the same reference numbers are used throughout the different figures to designate the same or similar components. Initially, reference should be made to FIG. 1 which illustrates the walkabout of a preferred embodiment of the invention. The walkabout 10 shown in FIG. 1 includes a base frame 1, upright sections 11' and a top frame with fall control assembly 12'. The base is assembled on a flat surface with the as yet open end of each 45 degree fitting facing to the left. The unopposed opening of each tee fitting faces up and at an angle to the left sufficient to accommodate the upright pieces which join the base to the smaller top. The base is comprised of a base right tee fitting 2' with straight pieces 410' and 411' inserted into the two opposing openings. Attached to piece 411' is a base front right side 45 degree fitting 3' into which is inserted a straight piece 4'. Attached to piece 4' is a base right front 45 degree fitting 31'. Fitting 31' is drilled to accept a screw on its' forward-most side. Slip-fit into 31' is a straight piece 41'. Attached to 41' is one of the opposing openings of base front tee fitting 21'. Inserted into the other opposing opening is a straight piece 42'. Slip-fit onto 42' is a base left front 45 degree fitting 32'. Fitting 32' is drilled to accept a screw on its' forward-most side. A cable 110' with an eye on each end 101', is attached to fittings 31' and 32' by use of a screw inserted through one eye then screwed into the hole drilled in the fitting. The process is repeated with the remaining eye and fitting. The cable length is such that it retains pieces 41', 42' in 31', 32' respectively while allowing tee fitting 21' to pivot. In FIG. 1 inserted into fitting 32' is straight piece 43'. Attached to piece 43' is a base front left side 45 degree fitting 33'. Inserted into fitting 33' is straight piece 44'. Attached to piece 44' is a base left tee fitting 22'. Inserted into fitting 22' is a straight piece 45'. Attached to piece 45' is a base rear left side 45 degree fitting 34'. Inserted into fitting 34' is a straight piece 46'. Attached to piece 46' is a base left side rear 45 degree fitting 36'. Inserted into fitting 36' is a straight piece 47'. Attached to piece 47' is a base rear tee fitting 23'. Inserted into fitting 23' is a straight piece 48'. Attached to piece 48' is a base right rear 45 degree fitting 37'. Inserted into fitting 37' is a straight piece 49'. Attached to piece 49' is a base rear right side 45 degree fitting 38'. Inserted into fitting 38' is the open end of 410'. The straight pieces are of such lengths that the completed base is rectangular with a tee fitting in the middle of each of the four sides. Each of the four corners is two 45 degree angles. Each 45 degree fitting and each tee fitting is drilled to accept a locking-castor assembly, units 6' thru 611'. The as yet unused opening of each tee is drilled, on the side facing out of the rectangle, to accept a detent pin 93.

Figure 2:
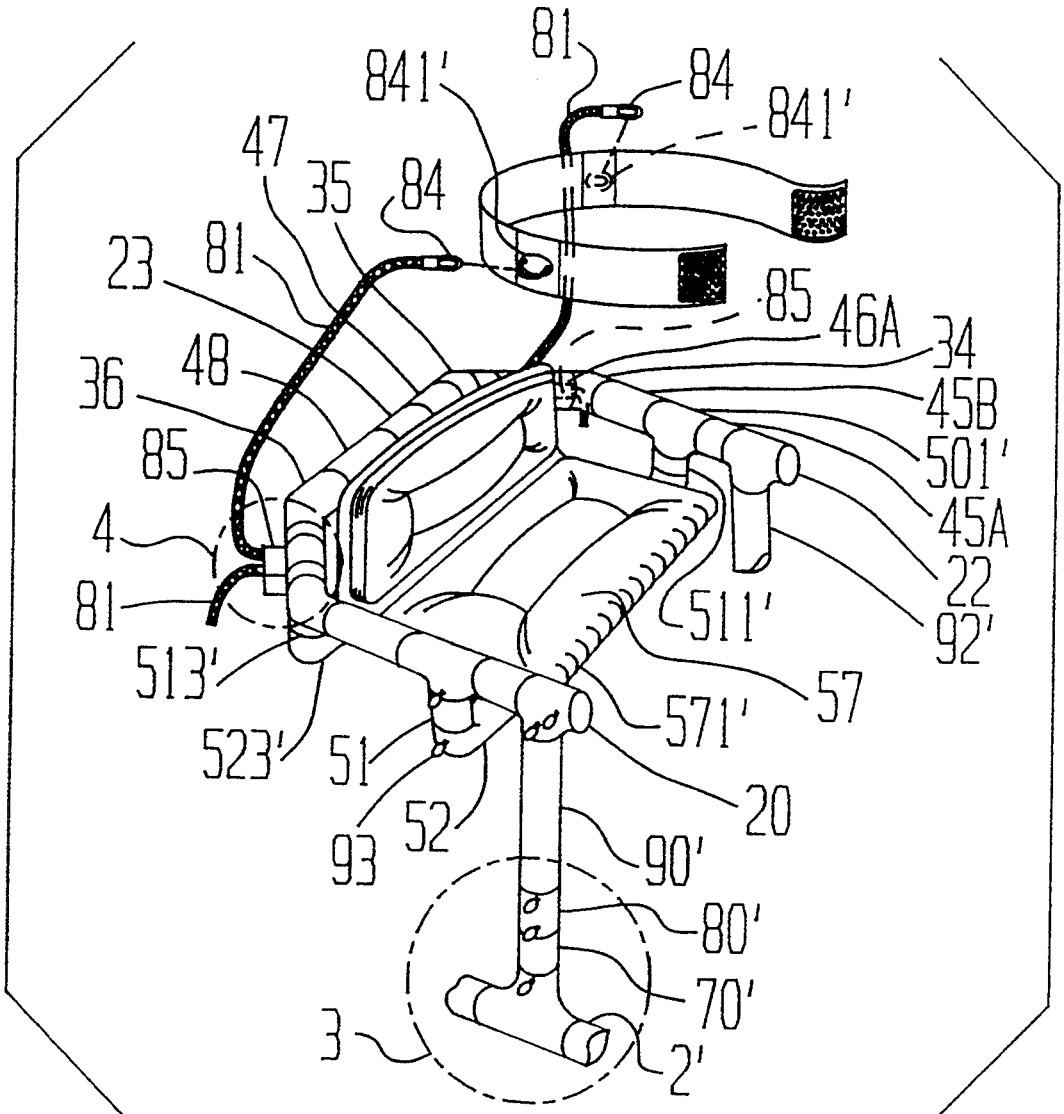
FIG. 2 shows details of a fall control assembly.
Figure 3:
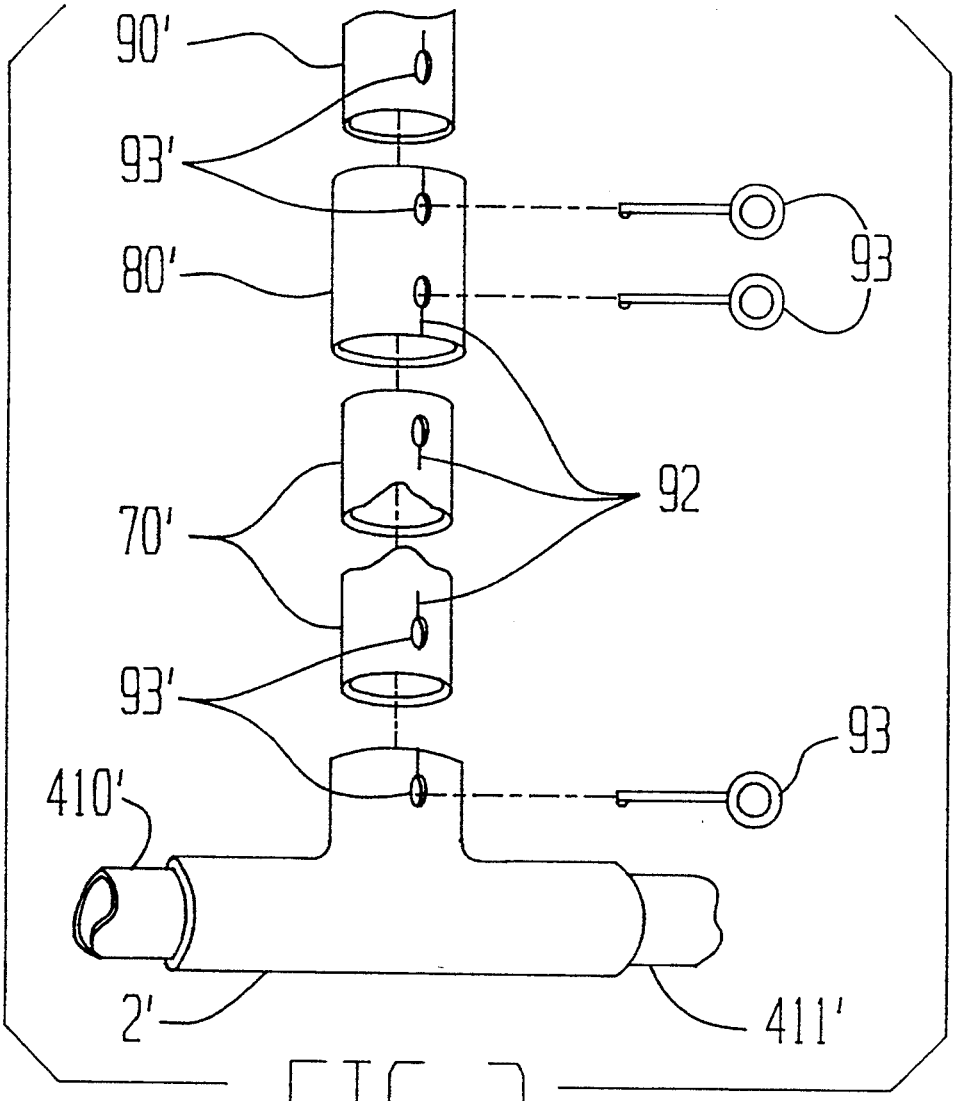
FIG. 3 shows details of a portion of the right side upright section of FIG. 1.
Figure 4:
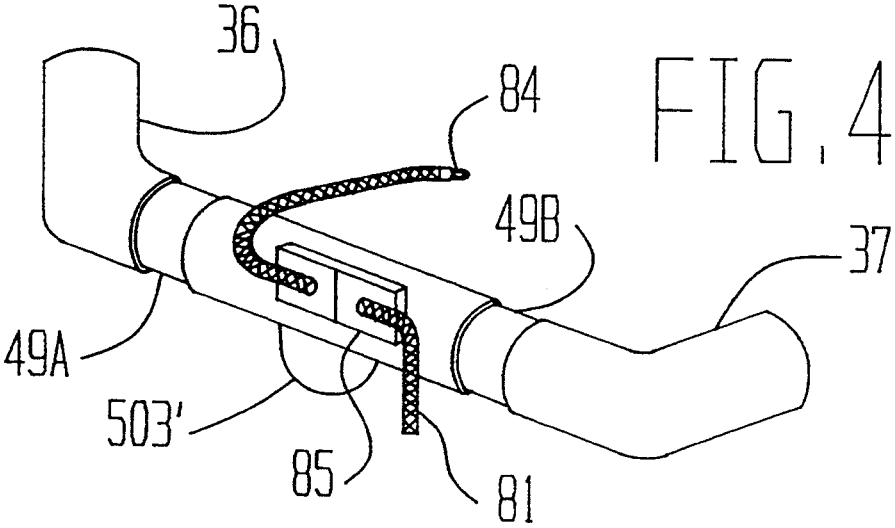
FIG. 4 is a perspective view of one attachment point of the fall control assembly to the top of the walker.

The top is assembled on a flat surface with the as yet open end of each 45 degree fitting facing to the left. The unopposed opening of each tee fitting faces down and at an angle sufficient to accommodate the upright pieces which join the smaller top to the larger base. The top is comprised of a right top tee fitting 20 with straight piece 410B inserted into the left opposing opening. Straight piece 411 is slip-fit into the right opposing opening of fitting 20. Attached to piece 411 is a top front right side 45 degree fitting 30 into which is inserted a straight piece 40. Attached to piece 40 is a top right front 45 degree fitting 31. Inserted into 31 is a straight piece 41. Attached to 41 is one of the opposing openings of top front tee fitting 21. Inserted into the other opposing opening is a straight piece 42. Attached to 42 is a top left front 45 degree fitting 32. Inserted into fitting 32 is straight piece 43. Attached to piece 43 is top front left side 45 degree fitting 33. Inserted into fitting 33 is straight piece 44. Slip-fit onto piece 44 is one of the opposing open ends of top left tee fitting 22. Inserted into fitting 22 is a straight piece 45A. Attached to piece 45A is one of the opposing open ends of seat left side tee 501' with the unopposed opening pointing down at a right angle to the work surface. Inserted into the open opposed end of fitting 501' is a straight piece 45B. Attached to piece 45B is a top rear left side 45 degree fitting 34. Inserted into fitting 34 is a straight piece 46A. Attached to piece 46A is one of the opposing open ends of a seat left rear tee 502' with the unopposed opening pointing down at a right angle to the work surface. Inserted into the open opposed end of fitting 502' is a straight piece 46B. Attached to piece 46B is a top left side rear 45 degree fitting 35. Inserted into fitting 35 is a straight piece 47. Attached to piece 47 is a top rear tee fitting 23. Inserted into fitting 23 is a straight piece 48. Attached to piece 48 is a top right side rear 45 degree fitting 36. Inserted into fitting 36 is a straight piece 49A. Attached to piece 49A is one of the opposing open ends of a seat left rear tee 503' with the unopposed opening pointing down at a right angle to the work surface. Inserted into the open opposed end of fitting 503' is a straight piece 49B. Attached to piece 49B is a top rear right side 45 degree fitting 37. Inserted into fitting 37 is a straight piece 410A. Attached to piece 410A is one of the opposing open ends of a seat right side tee 50 with the unopposed opening pointing down at a right angle to the work surface. Inserted into the open opposed end of fitting 50 is the open end of straight piece 410B. The straight pieces are of lengths that the completed base is rectangular with a tee fitting in the middle of each of the four sides. Each of the four corners is two 45 degree angles. The as yet unused opening of each tee is drilled, on the side facing out of the rectangle, to accept a detent pin 93. Slip-fit into fitting 50 is a straight piece seat right side vertical 51. Slip-fit onto piece 51 is a seat right side 90 degree fitting 52. Inserted into fitting 52 is a straight piece seat right side horizontal 53. Attached to piece 53 is one of the opposing open ends of a seat right side horizontal tee 54. Inserted into the open opposing end of fitting 54 is a straight piece seat horizontal tee connector 55. Attached to piece 55 is one of the opposing open ends of a tee fitting seat left side horizontal tee 541'. Inserted into the open opposing end of fitting 541' is a straight piece seat left side horizontal 531'. Attached to piece 531' is a 90 degree fitting seat left side 521'. Slip-fit into fitting 521' is a straight piece seat left side vertical 511'. The lengths of the straight pieces and the direction of attachment of the 90 degree fittings are such that the open end of piece 511' is slip-fit into the unopposed opening of seat left side tee fitting 501'. Inserted into the unopposed opening of tee fitting 541' is a straight piece seat left rear horizontal 532'. Attached to piece 532' is the unopposed opening of tee fitting 543'. Inserted into one of the opposed openings of piece 543' is connecting piece 542'. Attached to piece 542' is a 90 degree fitting seat left rear 522'. Slip-fit into fitting 522' is a straight piece seat left rear vertical 512'. The lengths of the straight pieces and the direction of attachment of the 90 degree fitting are such that the open end of piece 512' is slip-fit into the unopposed opening of seat left rear tee fitting 502'. Inserted into the unopposed opening of tee fitting 54 is a straight piece seat right rear horizontal 533'. Attached to piece 533' is the unopposed opening of tee fitting 555'. Inserted into one of the opposed openings of piece 555' is connecting piece 556'. Attached to piece 556' is a 90 degree fitting seat right rear 523'. Slip-fit into fitting 523' is a straight piece seat right rear vertical 513'. Inserted into the opposed open ends of piece 555' and 543' is connecting piece 544'. The lengths of the straight pieces and the direction of attachment of the 90 degree fittings are such that the open end of piece 513' is slip-fit into the unopposed opening of seat right rear tee fitting 503'. All slip-fit pieces are drilled to accept detent pins 93 to rigidly join them. Seat 57 is comprised of a rigid material of sufficient size and strength to accommodate a person determined to be larger than the general population. Seat 57 is a flat horizontal sitting surface and a flat vertical back-rest. Attached by a sufficient number of clamps and fasteners to parallel horizontal pieces 532' and 533' is the sitting surface of seat 57. Padding 571' is attached to and covers the sitting surface and front edge of seat 57. Padding 572' is attached to and covers the back-rest of seat 57. Referring now to FIG. 2 and FIG. 4, the fall control assembly consist of a loop and hook size adjustable strap 80. Cord attachment points, pad eyes 841', are positioned at the right and left rear corners of the strap. A cord 81 is attached to right pad eye 841' by a spring-loaded snap hook 84. The bitter end of cord 81 is passed through and made fast to clam cleat 85 which is attached to the far side of seat right rear tee 503' (shown more clearly in FIG. 4). Referring now to FIG. 2, a cord 81 is attached to left pad eye 841' by a spring-loaded snap hook 84. The bitter end of cord 81' is passed through and made fast to clam cleat 85 which is attached to the far side of seat left rear tee 502'. The fall control assembly creates two pivot points to the rear of occupant and at about 45 degrees to a front-to-rear center-line if drawn through top frame 12' of walkabout 10. Cords 81 are adjusted to a length that will cause a person wearing strap 80 around his waist to pivot onto seat 57 in the event of a fall. A portion of upright section 11' is detailed in FIG. 3. Sufficient alignment marks 92 and holes 93' drilled for detent pins 93 have been provided to allow assembly and height adjustment. The following process is repeated to assemble each of these groups of parts: #1 (2' BASE RIGHT TEE, 70' RIGHT UPRIGHT SPACER, 80' RIGHT SLIP JOINT, 90' RIGHT UPRIGHT POST, 20 TOP RIGHT TEE), #2 (21' BASE FRONT TEE, 71' FRONT UPRIGHT SPACER, 81' FRONT SLIP JOINT, 91' FRONT UPRIGHT POST, 21 TOP FRONT TEE), #3 (22' BASE LEFT TEE, 72' LEFT UPRIGHT SPACER, 82' LEFT SLIP JOINT, 92' LEFT UPRIGHT POST, 22 TOP LEFT TEE), #4 (23' BASE REAR TEE, 73' REAR UPRIGHT SPACER, 83' REAR SLIP JOINT, 94' REAR UPRIGHT POST, 23 TOP REAR TEE). Slip-fit into base tee 2' is a right upright spacer 70' of sufficient length to raise or lower top frame 12' of walkabout 10 to a height suitable to the requirements of a specific person using walkabout 10. Slip-fit onto upright spacer 70' is a slip joint 80'. Slip-fit into slip joint 80' is a upright arm 90'. Shown more clearly in FIG. 1, upright arm 90' is slip-fit into top right tee 20. Top right tee 20 and top left tee 22 have a hole 93' drilled in the forward-facing opposing open end to accept a detent pin to secure pieces 411 and 44 respectively in slip joints. Each piece has a hole 93' drilled near it's ends to accept the detent pins. The entire assembly is fastened using detent pins 93.

OPERATION—FIGS. 1-5

Figure 5:
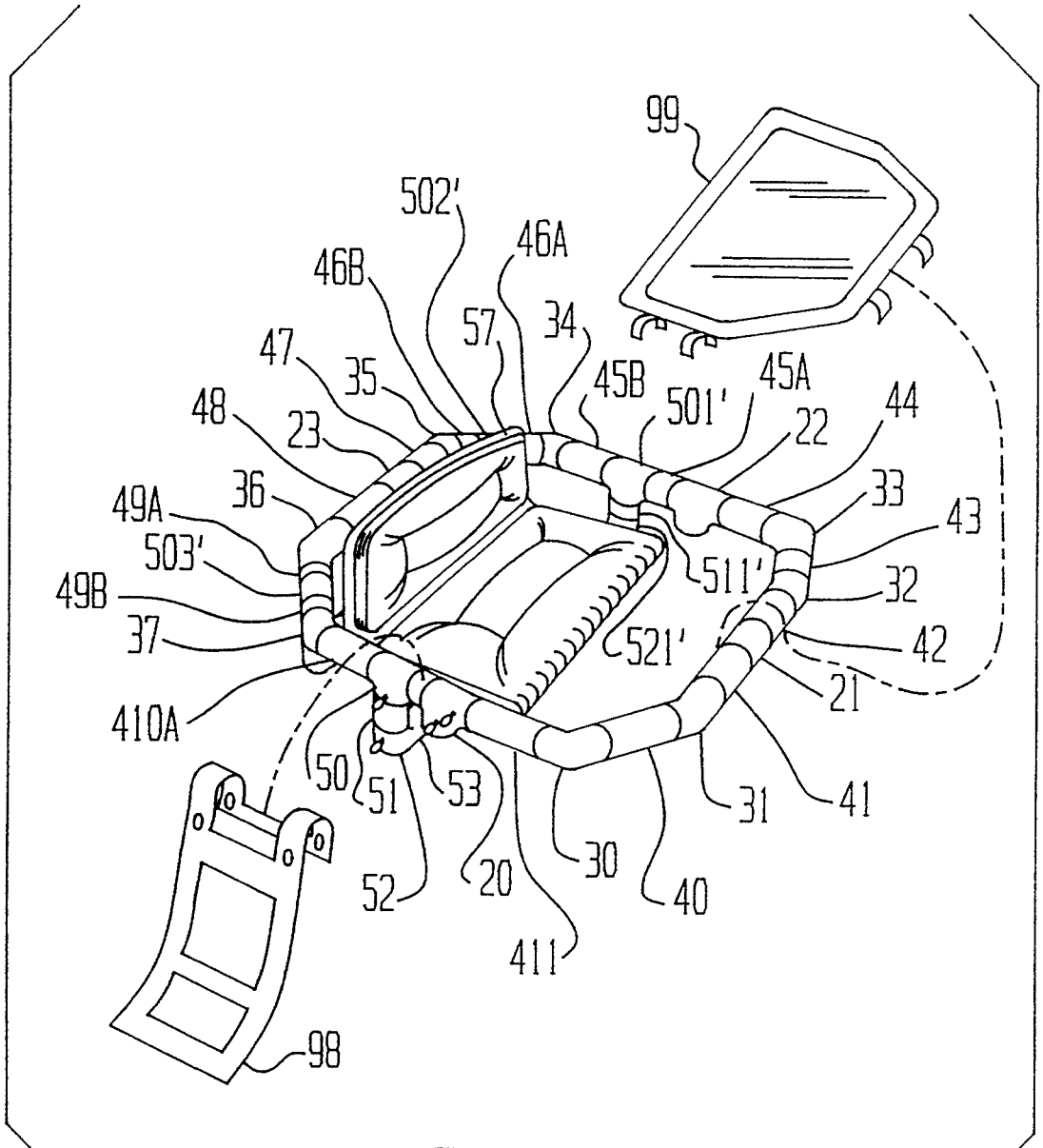
FIG. 5 shows some possible accessories.

Referring to FIG. 1, the top front section pivots forward at the base to allow easy access. Two or more of locking wheels 6'-611' hold the structure stationary while a person enters walkabout 10. Referring to FIGS. 2 & 4, fall control strap 80 is adjusted for proper fit about occupant's waist. The fall control cords 81 are adjusted for proper length to ensure correct pivoting onto seat 57 in the event of a fall. The front is pivoted back to a closed position by inserting pieces 411 and 44 into top right side tee 20 and top left side tee 22 respectively. The slip fit is held in place by inserting detent pins 93 into holes 93' in pieces 411, 44 and tees 20, 22 which align when pieces 411, 44 are inserted fully into tees 20, 22. Should it be necessary the front may be secured by a lock on each side. Occupant of walkabout 10 may remain stationary with some or all of wheels 6'-611' locked and use the seat and surrounding top structure 12' for support. With wheels 6'-611' unlocked occupant of walkabout 10 may move freely by sitting on seat 57 and use his or her feet against the floor for propulsion. With wheels 6'-611' unlocked occupant of walkabout 10 may stand and walk in a normal manner or use walkabout 10 for partial or complete support. Walkabout 10 is tapered inward from base 1 to rod 12' to create a stable structure for occupant walking with walkabout 10. In the event of a fall walkabout 10 supports occupant and fall control assembly of top frame 12' controls and guides occupant onto seat 57. Seat 57 height is adjusted by changing seat verticals 51, 511', 512', 513' (FIG. 1) with others of greater or lesser length. Walkabout 10 height is adjusted by changing upright spacers 70', 71', 72', 73' (FIG. 1) with others of greater or lesser length. Stability increases the higher top frame 12' is in relation to occupant. The height of walkabout 10 varies dependent upon the support requirements of occupant. The walkabout is highly mobile yet stable, provides fall control, easy to use. compact and neat in appearance, relatively low in cost to produce, and easy to maintain and service. Accessories such as trays 99 and various containers or pockets 98, as depicted in FIG. 5, can be added to the walker as desired.

Although the present invention has been depicted and described in terms of a single preferred embodiment, in the appended claims it is intended to include all those equivalent structures, some of which may be apparent upon reading this description and others that may be obvious after study and review.

SUMMARY, RAMIFICATIONS, AND SCOPE

Briefly described, and in accordance with one embodiment thereof, the walkabout provides a framework which surrounds the occupant. A top section pivots at the base to move outward to facilitate ingress and egress. Locking wheels hold the walkabout stationary. After a person enters the framework a strap is fitted around their waist and the top is secured shut. Two cords, attached to the strap at approximately the right rear and left rear, are adjusted to a length to provide a rearward pivot action should the occupant fall while using the walker. The pivot action will control the fall and guide the occupant onto the seat provided. The wheels can be left locked and the occupant can stand or sit. If the wheels are unlocked the occupant is free to walk about. The movement can be accomplished while seated by walking using the legs from the knees down, standing and walking in the normal manner, or any variation in between. The lightweight, compactness, and mobility of the walkabout provide the occupant with a high degree of freedom compared to walkers previously available. Accessories such as trays and various containers or pockets can be added to the walker as desired. Other wheels could be substituted to allow the walker to be used outdoors.

What is claimed is new and desired to be protected by Letters Patent is set forth in the appended claims:

1. A walker particularly suitable for use by persons with varying degrees of disability including in combination:

(a) a horizontal base frame of approximately rectangular shape, attached to said base frame a plurality of upright supports, said upright supports angle in to attach to a top frame of approximately rectangular shape of smaller circumference than the base frame;

(b) a free section of said top frame is attached to one upright supports having horizontal hinged means at the base to allow said section of the top frame to pivot outwardly about said base to allow a person to enter a region surrounded by the base frame and the top frame;

(c) locking means for rigidly locking the free section of the top frame to the top frame after said person has entered said region to securely enclose the person in the region;

(d) a plurality of rolling means attached to the base frame.

2. The walker of claim 1 further including a seat being rigidly attached to the top section by means of a plurality of vertical supports extending down from the top frame rearward of where the person stands to walk.

3. The walker of claim 2 further including a fall control assembly, said fall control assembly includes a restraint and a plurality of connections from said restraint to the walker creating pivot points to direct the person toward said seat in the event of a fall.

4. The walker of claim 3 further including means to adjust the length of the connection between the restraint and the walker.

5. The walker of claim 3 wherein the fall control assembly may be completely removed when used by persons with lesser degrees of disability.

6. The walker of claim 3 wherein the restraint uses a hook and loop mechanism for size adjustment.

7. The walker of claim 2 further including a backrest with padding on said backrest and padding on the seat.

8. The walker of claim 2 further including means to adjust seat height by replacing said plurality of vertical supports with others of greater or lesser length.

9. The walker of claim 2 wherein seat being rigidly attached to the top section by means of a plurality of vertical supports extending down from the top frame rearward of where the person stands to walk can be completely removed if so desired.

10. The walker of claim 1 further including means for adjusting height of top frame by changing length of the upright supports.

11. The walker of claim 1 wherein the size and adjusted height of the top frame in relation to the size of the base frame is sufficient to provide stability to the person using the walker.

12. The walker of claim 1 wherein the rolling means may further include units suitable for outdoor use of the walkabout.

13. The walker of claim 1 further including attachment of a tray, pockets or other means to hold articles.

14. The walker of claim 1 wherein height adjustment and connection of the base frame and the top frame is accomplished by means of a sufficient number of detent pins inserted into holes in the pieces that comprise the upright supports and the receptacles in the base frame and the top frame.

15. The walker of claim 1 further includes a cable to keep the base frame together on either side of where one or more upright supports pivot.

16. The walker of claim 1 wherein the upright supports can be removed from the base frame and the top frame for easy transport or storage of the walker.

17. The walker of claim 1 wherein any or all of the rigid connections of the base frame or the top frame can be of a detachable nature to facilitate adjustment or alteration.

18. The walker of claim 1 wherein the rolling means can be locked.

* * * * *